US009850025B2

(12) United States Patent
Ojima et al.

(10) Patent No.: US 9,850,025 B2
(45) Date of Patent: Dec. 26, 2017

(54) CAN LID AND BEVERAGE CAN

(71) Applicant: SHOWA ALUMINUM CAN CORPORATION, Tokyo (JP)

(72) Inventors: Shinichi Ojima, Tokyo (JP); Kazunori Ikeda, Tokyo (JP); Tetsuo Kashiwazaki, Tokyo (JP); Asumi Suwa, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 14/898,365

(22) PCT Filed: Apr. 9, 2014

(86) PCT No.: PCT/JP2014/060312
§ 371 (c)(1),
(2) Date: Dec. 14, 2015

(87) PCT Pub. No.: WO2015/004965
PCT Pub. Date: Jan. 15, 2015

(65) Prior Publication Data

US 2016/0145000 A1 May 26, 2016

(30) Foreign Application Priority Data

Jul. 10, 2013 (JP) ..... 2013-144529

(51) Int. Cl.
*B65D 17/34* (2006.01)
*B65D 17/00* (2006.01)

(52) U.S. Cl.
CPC .... *B65D 17/165* (2013.01); *B65D 2517/0014* (2013.01); *B65D 2517/0089* (2013.01)

(58) Field of Classification Search
CPC ..... B65D 17/165; B65D 2517/0089; B65D 2517/0014; B65D 1/20; B65D 7/04; B65D 17/02; B65D 17/24
(Continued)

(56) References Cited

U.S. PATENT DOCUMENTS 3,967,752 A 7/1976 Cudzik
4,289,251 A 9/1981 Maliszewski
(Continued)

FOREIGN PATENT DOCUMENTS

CA 1034520 A 7/1978
CN 102951343 A 3/2013
(Continued)

OTHER PUBLICATIONS

International Search Report of PCT/JP2014/060312 dated Jun. 17, 2014.

*Primary Examiner* — Kareen Thomas
(74) *Attorney, Agent, or Firm* — Sughrue Mion, PLLC

(57) ABSTRACT

A first score line (430) is provided with a modified groove width portion (435) in which the groove width differs from the groove width of other portions. This modified groove width portion (435) is formed by imparting curvature to a point of a first side surface (430B) and this portion of a second side surface (430C) are respectively distended in an outward direction. To describe further, the modified groove width portion (435) is formed by forming respective recessed portions in the first side surface (430B) and the second side surface (430C). In so doing, rupture of a panel can take place in satisfactory fashion along a score line having a branched portion.

8 Claims, 11 Drawing Sheets

(58) Field of Classification Search
USPC ..... 220/260, 265, 266, 268, 269, 270, 272, 220/273; 413/67; 426/123
See application file for complete search history.

(56) References Cited

U.S. PATENT DOCUMENTS

| | | | | |
|---|---|---|---|---|
| 5,711,448 | A | 1/1998 | Clarke, III | |
| 7,909,555 | B2 * | 3/2011 | Heinicke | B21D 51/383 220/265 |
| 8,047,754 | B2 * | 11/2011 | Heinicke | B21D 51/383 220/265 |
| 2008/0067174 | A1 * | 3/2008 | Heinicke | B65D 17/163 220/273 |
| 2013/0037542 | A1 * | 2/2013 | Crothers | B65D 17/165 220/269 |
| 2013/0299496 | A1 * | 11/2013 | Forrest | B65D 17/165 220/269 |

FOREIGN PATENT DOCUMENTS

| | | | |
|---|---|---|---|
| JP | 51-82188 | A | 7/1976 |
| JP | 2012-106754 | A | 6/2012 |
| JP | 2012-153427 | A | 8/2012 |
| JP | 2012-201381 | A | 10/2012 |

* cited by examiner

CAN LID AND BEVERAGE CAN

CROSS REFERENCE TO RELATED APPLICATIONS

This application is a National Stage of International Application No. PCT/JP2014/060312 filed Apr. 9, 2014, claiming priority based on Japanese Patent Application No. 2013-144529, filed Jul. 10, 2013, the contents of all of which are incorporated herein by reference in their entirety.

TECHNICAL FIELD

The present invention relates to a can lid and a beverage can.

BACKGROUND ART

A beverage can, in which an opening portion functioning as a tap is formed by cracking of a panel at a score line caused by applying pressure of a tab on part of the panel, has been suggested (for example, refer to Patent Document 1).

CITATION LIST

Patent Literature

Patent Document Japanese Patent Application Laid-Open Publication No. Sho 51-82188.

SUMMARY OF INVENTION

Technical Problem

Typically, a score line is formed on a surface of a panel in a can lid usable for a beverage can. Cracking of the panel progresses along the score line in forming an opening portion in the can lid. Here, in the case where the score line is branched in the middle, cracking of the panel occurs at each of the plural score lines on the downstream side beyond the branch part, and consequently an opening portion is formed in the can lid.

In the case where plural score lines are formed on the downstream side beyond the branch part, cracking start timing when cracking starts at each of the plural score lines may affect the formation of the opening portion in some cases. If the cracking start timing differs from the predetermined timing, an opening portion in a state different from the intended state may be formed in some cases because cracking of the panel along some of the score lines may be difficult to occur.

An object of the present invention is to appropriately crack the panel along the score line having the branch part.

Solution to Problem

The can lid to which this invention is applied is a can lid including: a panel that is attachable to an opening portion of a can body; a score line that is formed on the panel, that extends toward a predetermined extending direction, then is branched at a branch part, and further extends toward a plurality of directions, that includes a first branched score line and a second branched score line on a downstream side beyond the branch part in the extending direction, and that promotes cracking of the panel; and a speed decreasing unit that is provided so as to correspond to at least one branched score line of the first branched score line and the second branched score line, and that temporarily decreases progress rate in progressing cracking of the panel along the one branched score line.

Here, the one branched score line is formed by a groove on the surface of the panel, the one branched score line has any one of a part where the groove decreases in width and a part where the groove increases in width, and the progress rate is temporarily decreased at any one of the part where the groove decreases in width and the part where the groove increases in width. In this case, the branched score line partially decreases in width or partially increases in width, and thereby the progress rate in progressing cracking of the panel along the branched score line can be temporally decreased.

Further, the one branched score line is formed by a groove on the surface of the panel, the groove includes a bottom part, a first side surface, and a second side surface, the first side surface being located on one side of the groove in the width direction of the groove and facing the inside of the groove, the second side surface being located on the other side of the groove in the width direction of the groove and facing the inside of the groove, any one of a convex portion and a concave portion is formed on at least one side surface of the first side surface and the second side surface, and the progress rate is temporarily decreased at a part where any one of the convex portion and the concave portion is provided. In this case, the convex portion or the concave portion is provided on the side surface of the groove forming the branched score line, and thereby the progress rate in progressing cracking of the panel along the branched score line can be temporally decreased.

Furthermore, the one branched score line is formed by a groove on the surface of the panel, the groove includes a bottom part, a first side surface, and a second side surface, the first side surface being located on one side of the groove in the width direction of the groove and facing the inside of the groove, the second side surface being located on the other side of the groove in the width direction of the groove and facing inside of the groove, a first section and a second section are provided on at least one side surface of the first side surface and the second side surface, and a step is formed between the first section and the second section, the first section being located to be opposed to a corresponding section of the other side surface, the second section being disposed at a different position from the first section in the extending direction of the groove and being located to be close to the other side surface in comparison with the first section, and the progress rate is temporarily decreased at a part where the step is provided. In this case, the step is formed on the side surface of the groove forming the branched score line, and thereby the progress rate in progressing cracking of the panel along the branched score line can be temporally decreased.

Still furthermore, the one branched score line is formed to change the extending direction in the middle of extending toward the downstream side of the extending direction, and the progress rate is temporarily decreased at a part where the extending direction of the one branched score line is changed. In this case, the extending direction of the branched score line is changed in the middle, and thereby the progress rate in progressing cracking of the panel along the branched score line can be temporally decreased.

From another standpoint, the can lid to which this invention is applied is a can lid including: a panel that is attachable to an opening portion of a can body; a score line that is formed on the panel, that extends toward a predetermined extending direction, then is branched at a branch part, and further extends toward a plurality of directions, that comprises a first branched score line and a second branched score line on a downstream side beyond the branch part in the extending direction, and that promotes cracking of the panel, and a unit that is provided to correspond to at least one branched score line of the first branched score line and the second branched score line, d that temporarily delay cracking of the panel progressing along the one branched score line.

In the case where this invention is taken as a beverage can, the beverage can to which this invention is applied is a beverage can including: a can body that contains drink, and a can lid that is attached to the can body. Here, the can lid is the aforementioned can lid.

Advantageous Effects of Invention

According to the present invention, it is possible to appropriately crack the panel along the score line having the branch part.

DESCRIPTION OF EMBODIMENTS

Hereinafter, an exemplary embodiment of the present invention will be described in detail with reference to attached drawings.

Figure 1:
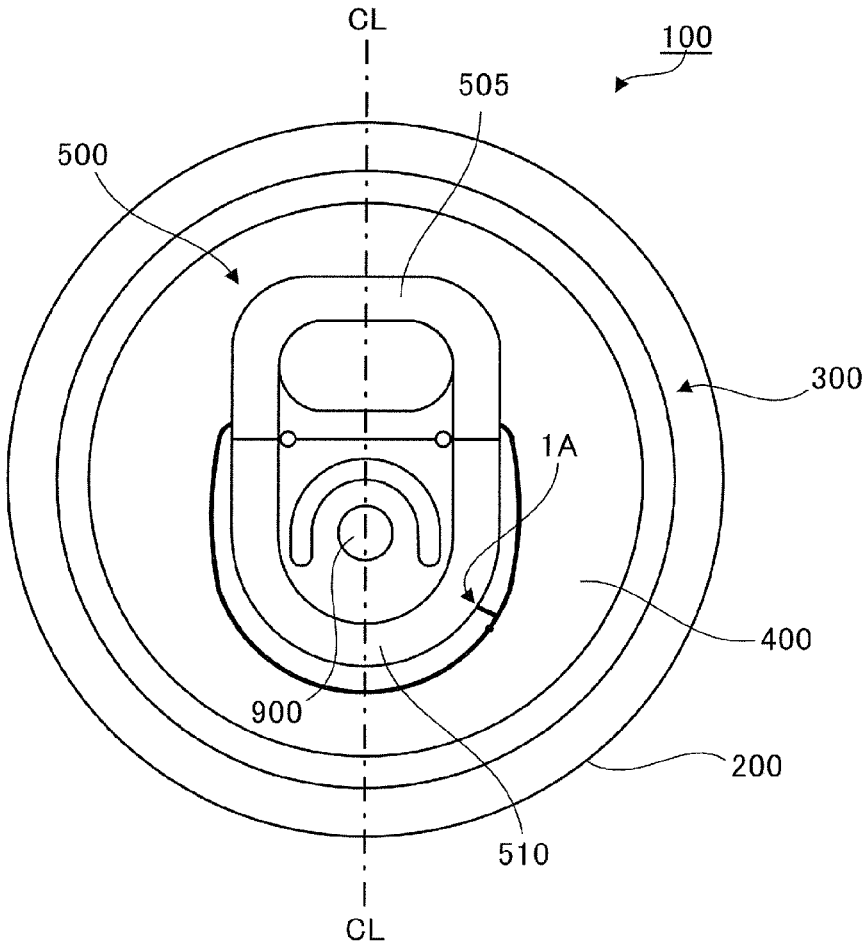
FIG. 1 is a top view of a beverage can to which the exemplary embodiment is applied.

FIG. 1 is a top view of a beverage can 100 to which the exemplary embodiment is applied. As shown in the figure, the beverage can 100 includes: a container body (can body) 200 that has an opening portion at the upper part and a bottom at the lower part, and that is formed into a cylinder; and a can lid 300 that is attached to the opening portion of the container body 200, and that covers the opening portion. Note that, drink such as refreshing beverage, soda, or alcohol is contained in the inside of the beverage can 100.

To the can lid 300, there is provided a panel 400 which is formed into a disk, functions as a basal plate, and is attachable to the opening portion of the container body 200. A tab 500 which is operable by a user is attached to the can lid 300. One end part of the tab 500 (upper end part in the figure is operated (pulled up) by a user, and thereby the other end part (front end part) of the tab 500 is pressed onto a predetermined area (which will be described below in detail) of the panel 400 to apply a pressure to the panel 400. Note that, the upper end part of the tab 500 in the figure is referred to as an operation target part 505, and the lower end part of the tab 500 in the figure is referred to as a front end part 510, in this description.

The tab 500 is secured to the panel 400 with a rivet 900 provided at a position displaced from the central part of the panel 400. That is to say, the tab 500 is secured to the panel 400 with the rivet 900 provided in an eccentric state with respect to the panel 400. Further, the tab 500 has a part located between the operation target part 505 and the front end part 510, the part being secured to the panel 400 with the rivet 900.

Note that, in the exemplary embodiment, description will be given for the case where the tab 500 is secured to the panel 400 with the rivet 900 provided at the position displaced from the central part of the panel 400 as one example. However, the tab 500 can be secured to the panel 400 with the rivet 900 provided at the central part of the panel 400. Additionally, in the exemplary embodiment, the tab 500 having the front end part 510 formed into an arc is exemplified. However, the tab 500 may be formed into a rectangle. In this case, the front end part 510 of the tab 500 is linearly formed.

With reference to FIGS. 2A to 2D (views illustrating the tab 500), the tab 500 will be further described.

Figure 2A:
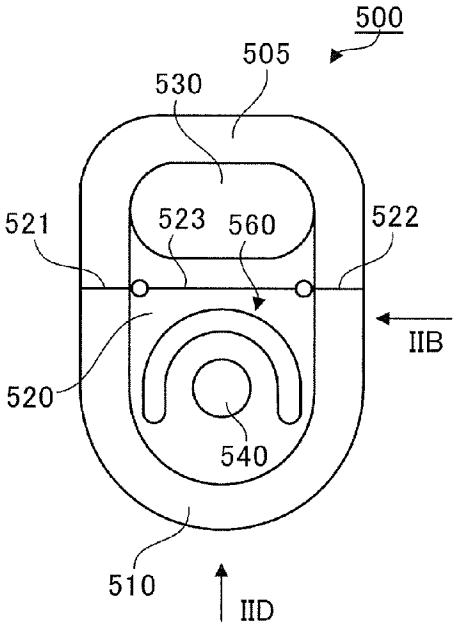
FIGS. 2A to 2D are views illustrating the tab.
Figure 2B:
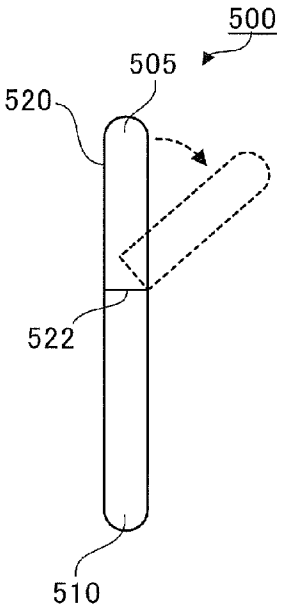
Figure 2C:
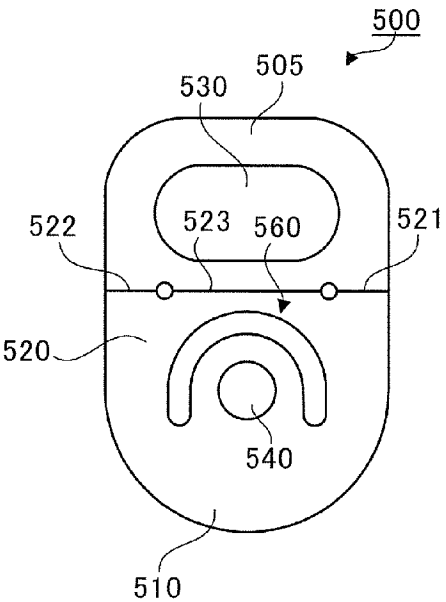
Figure 2D:
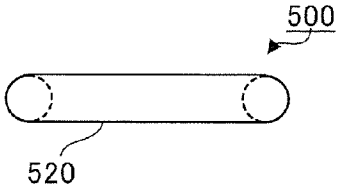

Note that, FIG. 2A is a front view of the tab 500, and FIG. 2B is a view of the tab 500 seen from an arrow IIB direction in FIG. 2A. FIG. 2C is a view of the rear surface of the tab 500. FIG. 2D is a view of the tab 500 seen from an arrow IID direction in FIG. 2A.

The tab 500 includes a tab body 520 formed into a plate and a rectangle-like shape, as shown in FIG. 2A. Note that, in the exemplary embodiment, a bending process (curl process) has been performed on the outer peripheral edge of the tab body 520 as shown in FIG. 2D, and thus the outer peripheral edge of the tab body 520 is curled inward. That is to say, curl portions are formed on the edge provided to four sides of the tab body 520.

Thereby, in the exemplary embodiment, the flexural rigidity of the tab 500 is enhanced. Further, a penetration hole (finger hole) 530 into which a finger of a user is insertable is formed on the side (operation target part 505 side) opposite to the side where the front end part 510 is provided in the tab 500, as shown in FIG. 2A. Furthermore, an insertion hole 540 into which a protrusion 420 (to be described later) provided in the panel 400 is insertable is formed on the front end part 510 side in the tab 500. Still furthermore, a penetration part 560 that is formed into a U-shape and penetrates the tab body 520 is provided around the insertion hole 540.

A first slit 521 is formed in one curl portion provided, along the longitudinal direction of the tab 500 out of the four curl portions provided to the four sides of the tab body 520. A second slit 522 is formed in another curl portion also provided along the longitudinal direction of the tab 500 out of the four curl portions. A groove 523 is formed along the lateral direction of the tab 500 at a part between the first slit 521 and the second slit 522 in the tab body 520.

The first slit 521, the second slit 522 and the groove 523 are provided on the same straight line. Further, the first slit 521, the second slit 522, and the groove 523 are provided along the width direction of the tab 500. Furthermore, the first slit 521, the second slit 522, and the groove 523 are disposed between the insertion hole 540 and the penetration hole 530. In the exemplary embodiment, the first slit 521, the second slit 522, and the groove 523 are formed in this manner, and the rigidity al rigidity) at the parts where they are formed decreases.

Thus, the tab 500 starts to be folded in response to application of a load on the operation target part 505 side of the tab 500, as shown in FIG. 2B. Note that, in the exemplary embodiment, the groove 523 is formed between the first slit 521 and the second slit 522 to decrease the rigidity at this part. However, the configuration is not limited to the groove, and performing a bending processing can decrease the rigidity, for example. Moreover, the groove 523 is not essential, and may be omitted.

Note that, in the case where a load acting in the direction opposite to the arrow direction shown in FIG. 2B is applied on the operation target part 505 (the case where the load acting in the left direction in the figure is applied on the operation target part 505), two split surfaces due to the first slit 521 and the like (parts included in the tab 500, and located on both sides of the first slit 521 and the like) face each other, and the tab 500 is prevented from being folded.

Figure 3:
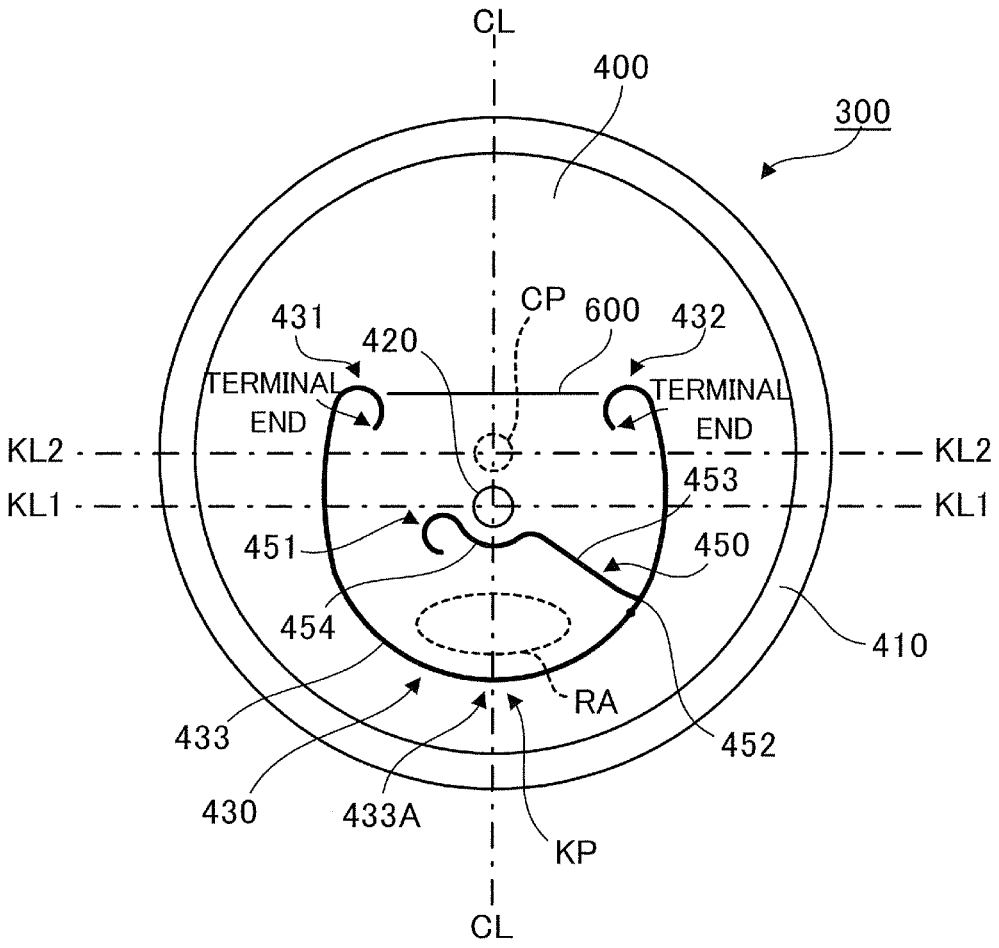
FIG. 3 is a front view of the can lid before the tab is attached thereto.

FIG. 3 is a front view of the can lid 300 before the tab 500 is attached thereto.

The can lid 300 in the exemplary embodiment includes a panel 400 formed into a disk. The panel 400 has an outer peripheral edge 410 on which a bending process has been performed. In the exemplary embodiment, a so-called scam process is performed on the outer peripheral edge 410 and an upper edge part (not shown) of the container body 200 (refer to FIG. 1) in the state where the outer peripheral edge 410 and the upper edge part are in contact with each other. Thereby, the can lid 300 (the panel 400) is secured to the upper edge part of the container body 200.

In the can lid 300, a protrusion (nipple) 420 which is flattened at securing the tab 500 to the panel 400 and becomes the aforementioned rivet 900 (refer to FIG. 1) is formed. The protrusion 420 is provided at a part displaced from the central part CP of the panel 400. A first score line 430 formed into a U-shape is formed on the surface of the panel 400.

The first score line 430 is constituted by a groove formed on the surface of the panel 400, and has a function for guiding cracking of the panel 400 (to be mentioned later). That is to say, the first score line 430 can be taken as a planned cracking line where the panel 400 is planned to crack. More specifically, the first score line 430 has a function for promoting the cracking of the panel 400 caused by application of a pressure of the tab 500 onto the panel 400 so that the cracking occurs at the predetermined part of the panel 400.

The first score line 430 is formed to expand toward the outer peripheral edge 410 side of the panel 400 from the central part side of the panel 400, and is formed into a I-shape when the panel 400 is viewed from the front side. Further, the first score line 430 has one end part 431 and the other end part 432 on the central part CP side of the panel 400, and a top part 433A on the outer peripheral edge 410 side of the panel 400. Note that a region RA to be pressed by the tab 500, which is included in the panel 400, is located within a region surrounded by the first score line 430, in the exemplary embodiment.

The one end part 431 of the first score line 430 is disposed on one region side (the left region in the figure) out of two regions opposed to each other with respect to a center line CL of the tab 500 (center line along the longitudinal direction of the tab 500) (also refer to FIG. 1). On the other hand, the other end part 432 is disposed on the other region side (the right region in the figure) out of the two regions opposed to each other with respect to the center line CL. In the exemplary embodiment, the first score line 430 is formed so as to be symmetric with respect to the center line CL of the tab 500 as the symmetry axis.

By separately providing the one end part 431 and the other end part 432, a discontinuous part where the first score line 430 is not formed is provided between the one end part 431 and the other end part 432 in the panel 400. By providing the discontinuous part, a tongue part which will be mentioned later is not detached from the panel 400, and is kept to be attached to the panel 400. Note that the center line CL of the tab 500 passes through the central part CP of the panel 400 and the protrusion 420 formed in the panel 400, as shown in FIG. 3, in the exemplary embodiment.

In the exemplary embodiment, in the case where a first virtual line KL1 taking as a virtual line orthogonal to the center line CL and passing through the protrusion 420 (rivet 900) is assumed to be set, the one end part 431 and the other end part 432 are located on the central part CP side of the panel 400 relative to the first virtual line KL1.

In the exemplary embodiment, the top part 433A is located in one region out of two regions opposed to each other with respect to a second virtual line KL2 orthogonal to the center line CL and passing through the central part CP of the panel 400, and the one end part 431 and the other end part 432 are located in the other region, as shown in FIG. 3.

Further, the protrusion 420 which becomes the rivet 900 is provided in a part surrounded by the first score line 430 in the panel 400, and is located on the top part 433A side with respect to the one end part 431 and the other end part 432 of the first score line 430. The first score line 430 has a curve part 433 as shown in FIG. 3. The first score line 430 includes the curve part 433 as shown in FIG. 3. The curve part 433 expands toward the side where the protrusion 420 is provided while connecting the one end part 431 and the other end part 432, and passes on the outer peripheral edge 410 side of the panel 400 with respect to the protrusion 420. The curve part 433 has the top part 433A at a point where the curve part. 433 intersects with the center line CL.

In the exemplary embodiment, in response to operation of the tab 500 by a user, the region surrounded by the first score line 430 is pressed by the tab 500, and cracking of the panel 400 occurs at the section where the first score line 430 is formed (which will be mentioned later in detail). Thereby, the region within the first score line 430 becomes a tongue-shaped part, and the region is folded toward the inside of the beverage can 100. Thereby, an opening portion functioning as a tap is formed on the beverage can 100.

Note that, hereinbelow in this description, the aforementioned tongue-shaped part formed by the cracking occurring at the first score line 430 may be referred to as a tongue part in some cases.

In other words, the inside region surrounded by the first score line 430 is pressed by the tab 500, and is separated from the panel 400 because of cracking of the first score line 430. However, since the cracking of the score line does not occur at the aforementioned discontinuous part between the one end part 431 and the other end part 432 of the first score line 430, where the score line is not formed, there is no problem about the separation from the panel 400. That is, the inside region surrounded by the first score line 430 bends while the connection with the panel 400 is maintained at the discontinuous part, and is pressed down to the inside of the beverage can 100.

In the exemplary embodiment, the second score line 450 is formed on the surface of the panel 400. The second score line 450 is also constituted by a groove formed on the surface of the panel 400, and has a function for guiding the cracking of the panel 400. The second score line 450 is provided within a region where the top part 433A (the top part 433A of the first score line 430) is provided, out of two regions opposed to each other with respect to the first virtual line KL1.

The second score line 450 has one end part 451 and the other end part 452. Here, the other end part 452 of the second score line 450 is connected to the curve part 433 of the first score line 430. Thus, in the exemplary embodiment, the score line is branched at the part where the first score line 430 and the second score line 450 are connected.

The other end part 452 of the second score line 450 is connected to the part which is included in the curve part 433 of the first score line 430 and which is located between the center line CL, and the first virtual line KL1. More specifically, the other end part 452 of the second score line 450 is connected to the part located between the top part 433A and the other end part 432 in the first score line 430. Further, the either end part 452 of the second score line 450 is connected to the part other than the part where the top part 433A is provided, in the first score line 430.

More specifically, the connection between the first score line 430 and the second score line 450 is provided in a part other than the intersection KP where the center line CL and the first score line 430 intersect with each other. In the exemplary embodiment, the second score line 450 extends toward the inside of the region surrounded by the first score line 430 from the connection with the first score line 430.

In the exemplary embodiment, the connection between the first score line 430 and the second score line 450 is provided on the side where the aforementioned intersection KP is provided, with respect to the first virtual brie KL1 disposed to be orthogonal to the center line CL. In other words, in the exemplary embodiment, the connection between the first score line 430 and the second score line 450 is provided on the side where the region RA is located, with respect to the first virtual brie KL1 disposed to be orthogonal to the center line CL.

In the exemplary embodiment, the distance between the one end part 431 of the first score line 430 and the connection between the first score line 430 and the second score line 450 is greater than the distance between the other end part 432 of the first score line 430 and the connection. More specifically, the length of the part located between the one end part 431 and the connection in the first score line 430 is greater than the length of the part located between the other end part 432 and the connection in the first score line 430.

Note that, in the exemplary embodiment, the description has been given in the case where the second score line 450 is formed to extend from the central part side of the panel 400 toward the bottom-right direction in the figure. However, the second score line 450 may be alternatively formed to extend toward the bottom-left direction in the figure. In this case, the second score line 450 is connected to the part located between the top part 433A and the one end part 431 in the first score line 430.

The one end part 451 of the second score line 450 is provided in the vicinity of the protrusion 420. Further, the one end part 451 of the second score line 450 is disposed on one region side out of two regions opposed to each other with respect to the center line CL, and the other end part 452 of the second score line 450 is disposed on the other region side out of these two regions.

Further, the second score line 450 has a straight-line part 453 extending from the other end part 452 toward the protrusion 420. In addition, the second score line 450 has the curve part 454 which is connected to the straight-line part 453, which keeps a distance from the protrusion 420 formed into a cylinder, and which is formed along the outer circumferential edge of the protrusion 420.

The curve part 454 of the second score line 450 is formed between the protrusion 420 and the first score line 430. More specifically, the curve part 454 is formed between the top part 433A of the first score line 430 and the protrusion 420, That is to say, the curve part 454 of the second score line 450 is disposed between the protrusion 420 and the first score line 430 on the center line CL.

Further, the curve part 454 is provided to pass between the protrusion 420 and the region RA included in the panel and to be pressed by the tab 500. That is to say, in the exemplary embodiment, the second score line 450 is provided to pass the side where the protrusion 420 (rivet 900) is provided with respect to the aforementioned region RA, and to pass between the region RA and the protrusion 420.

The curve part 454 of the second score line 450 is provided to intersect with the center line CL. Specifically, the second score line 450 in the exemplary embodiment passes between the region RA and the protrusion 420, then extends along the direction intersecting with the center line CL, and is connected to the first score line 430. More specifically, the second score line 450, which extends along the direction intersecting with the center line CL and toward the first score line 430, passes beside the region RA.

After passing between the region RA and the protrusion 420, the second score line 450 extends so as to gradually get away from the first virtual line KL1, and is connected to the first score line 430.

Here, the can lid 300 is further described with reference to FIGS. 4A to 4F (views illustrating states of the can lid 300 during operation of the tab 500). Note that, each of FIGS. 4A to 4F illustrates two states of the can lid 300, including a state when the can lid 300 is seen from the front side and a state when the can lid 300 is seen from the lateral side.

In the exemplary embodiment, when the operation target part 505 (rear end part) (refer to FIG. 1) of the tab 500 is pulled up by a user, the front end part 510 of the tab 500 presses the region RA (refer to FIG. 3) located between the curve part 454 of the second score line 450 and the top part 433A of the first score line 430. In response to the pressure onto the region RA with the tab 500, firstly, the panel 400 cracks at the curve part 454 of the second score line 450 which is provided to pass between the region RA and the rivet 900 (protrusion 420) (refer to FIG. 4B).

Figure 4A:
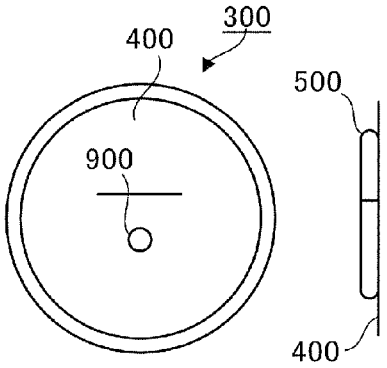
FIGS. 4A to 4F are views illustrating states of the can lid during operation of the tab.
Figure 4B:
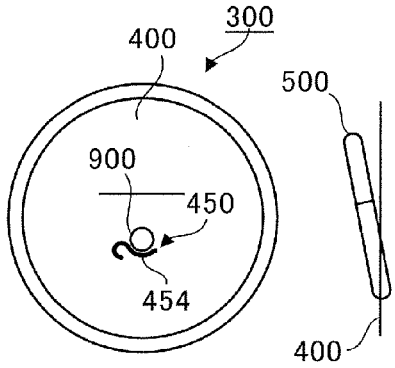
Figure 4C:
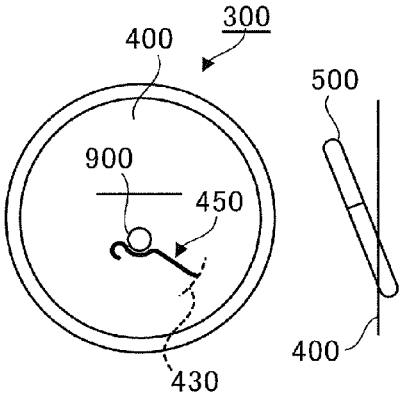
Figure 4D:
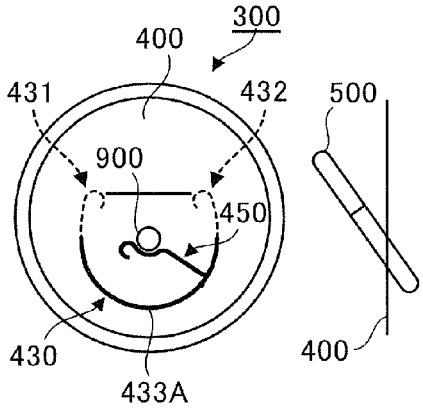

Then, the cracking of the panel 400 progresses along the second score line 450 to the connection between the first score line 430 and the second score line 450, as shown in FIG. 4C. Thereafter, in the exemplary embodiment, cracking of the panel 400 progresses from the connection toward the one end part 431 of the first score line 430, and from the connection toward the other end part 432 of the first score line 430, as shown in FIG. 4D.

That is to say, since the score line is configured to be branched at the connection between the first score line 430 and the second score line 450 in the exemplary embodiment, the score line that has extended to the connection along the second score line 450 is divided after passing through the branched area (branch part), and further extends toward the one end part 431 and the other end part 432.

More specifically, after the score line in the exemplary embodiment is branched at the connection (branch part) and is divided, part of the score line is regarded as a first branched score line, and the another part thereof is regarded as a second branched score line. The first branched score line extends toward the one end part 431, and the second branched score line extends toward the other end part 432.

Figure 4E:
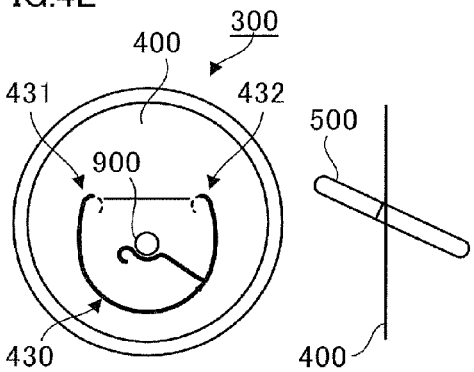

After that, in the exemplary embodiment, the tab 500 is pressed down toward the inside direction of the beverage can 100 by the user. Thereby, cracking of the panel 400 further progresses to the one end part 431 and the other end part 432 of the first score line 430 as shown in FIG. 4E. Consequently, the region surrounded by the first score line 430 becomes the tongue part. The tongue part is folded at the base of the tongue part (the part located between the one end part 431 and the other end part 432 of the first score line 430), and the tongue part enters the inside of the beverage can 100.

Figure 4F:
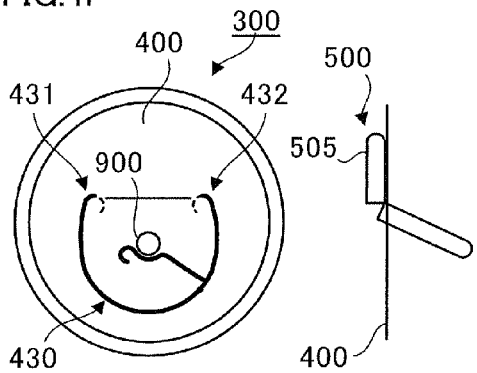

Thereby, an opening portion functioning as a tap is formed on the beverage can 100. Then, the user operates the operation target part 505 side of the tab 500, and the tab 500 is folded as shown in FIG. 4F. Thus, the operation target part 505 side of the tab 500 is located along the panel 400 of the can lid 300. Note that, in this case, obstacle at drinking is avoided because of no projection of the operation target part 505 side.

Here, in the exemplary embodiment, since the tab 500 is folded in this manner, the state where the front end part 510 of the tab 500 is placed into the inside of the beverage can 100 is maintained. That is to say, even if the tab 500 having been pulled up is laid along the panel 400, the state where the front end part 510 of the tab 500 is placed into the inside of the beverage can 100 is maintained. Thereby, the formed opening portion is prevented from being occupied by the front end part 510 of the tab 500, and a larger opening portion is obtained.

Note that, although the foldable tab 500 has been described, as one example in the exemplary embodiment, the tab 500 that is not foldable can be used as a matter of course. Note that, in the case where the tab 500 that is not foldable is used, it is preferable to reduce the projecting amount of the operation target part 505 of the tab 500.

Figure 5:
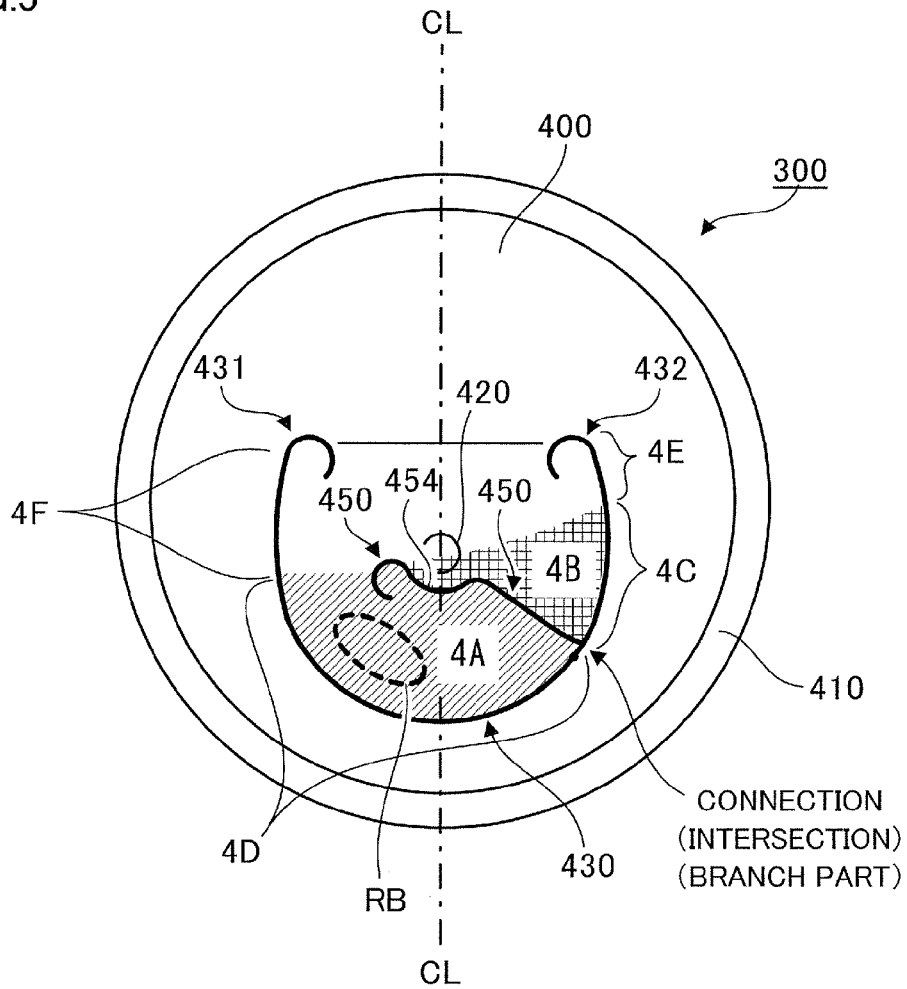
FIG. 5 is a view illustrating cracking of the panel.

Cracking of the panel 400 occurring at the first score line 430 and the second score line 450 will be further described with reference to FIG. 5 (a view illustrating cracking of the panel 400).

In the exemplary embodiment, as mentioned above, when a user pulls up the operation target part 505 of the tab 500, the region RA (refer to FIG. 3) located between the curve part 454 of the second score line 450 and the top part 433A of the first score line 430 (refer to FIG. 3) is pressed by the tab 500. Thereby, the panel 400 cracks firstly at the curve part 454 (refer to FIG. 5) of the second score line 450.

Then, the cracking of the panel 400 progresses along the second score line 450, and the cracking of the panel 400 progresses to the connection between the first score line 430 and the second score line 450. Thereafter, cracking of the panel 400 starts at the first score line 430. Specifically, the cracking of the panel 400 occurs in the region denoted by a reference numeral 4C in the first score line 430.

More specifically, in the exemplary embodiment, the tab 500 is pressed onto the region RA, and the region RA is pressed toward the inside direction of the beverage can 100. At this time, the protrusion 420 is pulled toward the outside direction of the beverage can 100 (front side direction of the paper surface in FIG. 5) by the tab 500. Thereby, a part denoted by a reference numeral 4B in FIG. 5 is pulled toward the outside direction of the beverage can 100. As a result, shearing force acts on the region denoted by a reference numeral 4C, and the panel 400 cracks in the region denoted by the reference numeral 4C. That is to say, the panel 400 cracks at the part included in the first score line 430 and located on the other end part 432 side beyond the connection.

In the exemplary embodiment, the tab 500 continues to press the region RA, and thereby part of the panel 400 denoted by a reference numeral 4A is pressed toward the inside direction of the beverage can 100. Consequently, shearing force acts on a region denoted by a reference numeral 4D, and the panel 400 cracks in the region denoted by the reference numeral 4D. That is to say, the panel 400 cracks at the part included in the first score line 430 and located on the one end part 431 side beyond the connection.

Thereafter, in the exemplary embodiment, the tab 500 is pressed down toward the inside direction of the beverage can 100 by the user, and thereby cracking of the panel 400 further occurs in the first score line 430. Specifically, the panel 400 cracks in two regions denoted by reference numerals 4E and 4F in the figure. Further, in the exemplary embodiment, the tongue part is folded at the bottom of the tongue part (part located between the one end part 431 and the other end part 432 of the first score line 430). Thereby, the tongue part enters into the inside of the beverage can 100, and an opening portion is formed in the beverage can 100.

In the case where the panel 400 cracks earlier on the other end part 432 side beyond the connection and then cracks on the one end part 431 side as described in the exemplary embodiment, an operation load when a user operates the tab 500 decreases.

For example, in the case where cracking of the panel 400 occurs simultaneously on the one end part 431 side beyond the connection and the other end part 432 side beyond the connection, cracking of the panel 400 starts simultaneously at the two parts. In this case, an operation load required for cracking at the two parts is necessary to be applied with the tab 500, and thus the operation load, of the tab 500 increases.

On the other hand, in the case where the panel 400 cracks earlier on the other end part 432 side beyond the connection and then cracks on the one end part 431 side beyond the connection as described in the exemplary embodiment, only an operation load required for cracking at one part is applied with the tab 500. In this case, the operation load of the tab 500 is smaller than in the case where the panel 400 cracks simultaneously at the two parts.

Further, in the case where the panel 400 cracks earlier on the other end part 432 side beyond the connection, and then cracks on the one end part 431 side beyond the connection as described in the exemplary embodiment, a user more securely forms an opening portion (tap) in the can lid 300.

Here, if the panel 400 cracks earlier on the one end part 431 side beyond the connection, the panel 400 is difficult to crack from the connection toward the other end part 432 side. Thus, the region located inside the first score line 430 may not entirely become an opening portion, and an opening portion in an imperfect state may be formed in some cases.

More specifically, in the case where the panel 400 cracks earlier on the one end part 431 side beyond the connection, the front end part 510 of the tab 500 first enters into the inside of the beverage can 100. In this case, the support of the front end part 510 by the panel 400 (support from below) is lost. If the support of the front end part 510 is lost in this manner, the protrusion 420 is difficult to be pulled (toward the outside direction of the beverage can 100) by the tab 500. Thus, in this case, shearing force is difficult to act on the aforementioned region denoted by the reference numeral 4C, and the panel 400 is difficult to crack in the region denoted by the reference numeral 4C.

Further, if cracking of the panel 400 occurs earlier on the one end part 431 side beyond the connection, tilt or rotation of the tab 500 is caused, and thereby an opening portion is difficult to be formed. More specifically, in the case where the panel 400 cracks earlier on the one end part 431 side beyond the connection, a small opening portion (hereinafter referred to as "small opening") is formed in the region denoted by the reference numeral 4A in FIG. 5, and the front end part 510 of the tab 500 enters into the inside of the beverage can 100 through the small opening. Then, in response to the entrance of the front end part 510 of the tab 500 in this manner, the edge of the small opening and the outer peripheral edge of the tab 500 make a contact with each other at the part denoted by the reference numeral 1A in FIG. 1.

In this case, the contact part where the edge of the small opening and the outer peripheral edge of the tab 500 make a contact with each other is located on the position displaced from the center line CL of the tab 500. Thus, if the operation of the tab 500 (pulling-up of the operation target part 505 side) is continued, the tab 500 tilts. In addition, in this case, rotation of the tab 500 about the rivet 900 may be caused in some cases. Upon occurrence of tilt or rotation of the tab 500 in this manner, shearing force is difficult to act on the aforementioned region denoted by the reference numeral 4C, and the opening portion is difficult to be formed in the panel 400.

Moreover, in the case where the panel 400 cracks on the one end part 431 side from the connection and does not crack from the connection to the other end part 432 side at all, the region denoted by the reference numeral 4A of the panel 400 is pressed into the inside of the beverage can 100, and the front end part 510 of the tab 500 starts to press the edge of the small opening at the part denoted by the reference numeral 1A in FIG. 1. At this time, the edge of the small opening makes a contact with a part of the front end part 510 of the tab 500, the part being displaced from the center line CL. Thus, the reaction force from the edge of the small opening against the pressure is an eccentric load to the tab 500, and the tab 500 may tilt and rotate about the rivet 900 in the clockwise direction. In this case, the front end part 510 of the tab 500 starts to press the region RB, and thus the panel 400 cracks only from the connection to the one end part 431 side, and the panel 400 does not crack from the connection to the other end part 432 side. In this case, an opening portion, the size of which is approximately half of the opening portion to be originally formed, is formed in the panel 400. On the other hand, in the case where the panel 400 cracks from the connection to the other end part 432 side and does not cracks from the connection to the one end part 431 side at all, the tab 500 can continue to press the region RA (refer to FIG. 3) without tilt or rotation as mentioned above. Thus, the panel 400 then cracks from the connection to the one end part 431 side. Even if the front end part 510 of the tab 500 presses the region 4A toward the inside of the beverage can 100 and makes a contact with the edge of the small opening, the reaction force from the edge of the small opening is small since the panel 400 already has been cracked in the region 4B. Thus, the tab 500 does not tilt or rotate. In this case, the opening portion to be originally formed is formed in the panel 400. Thus, it is desirable that the cracking of the panel 400 from the connection should progress toward the other end part 432 side earlier than the one end part 431 side.

By the way, the cracking of the panel 400 occurring earlier on the one end part 431 side beyond the connection can be inhibited by appropriately setting various parameters such as the shape/material of the panel 400, the shape of the first score line 430, the shape of the second score line 450, and the shape/material of the tab 500. However, the above cracking is difficult to be perfectly inhibited from occurring, and the panel 400 may crack earlier on the one end part 431 side beyond the connection, depending on the tolerances of the dimensions of units or an operation manner of a user.

To avoid this, in the exemplary embodiment, even in the case where the cracking of the panel 400 occurs earlier on the one end part 431 side beyond the connection, progress of the cracking is designed to be temporarily slowed down (the progress rate of the cracking is designed to be temporarily decreased), and the operation load from the tab 500 is designed to be applied on the other end part 432 side (part included in the first score line 430 and located on the other end part 432 side beyond the connection). Hereinbelow, the design for applying the operation load from the tab 500 on the other end part 432 side will be described.

Figure 6:
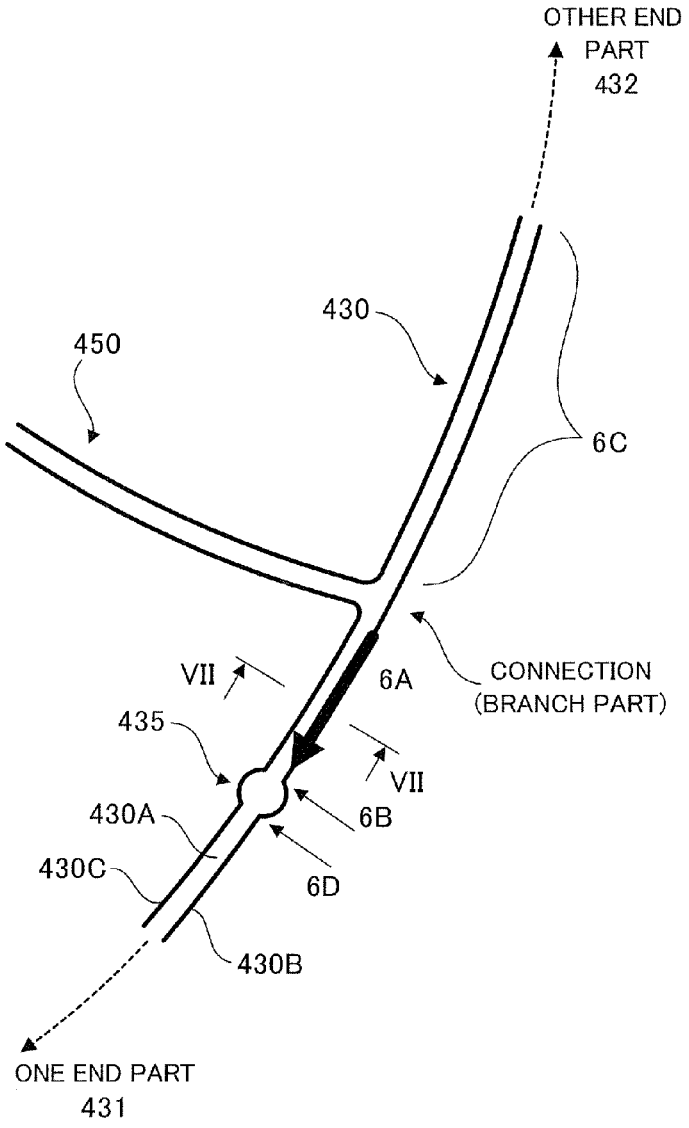
FIG. 6 is an enlarged view of the connection between the first score line and the second score line.

FIG. 6 is an enlarged view of the connection between the first score line 430 and the second score line 450.

As shown in the figure, in the exemplary embodiment, a groove width changing portion 435 that is different in width from (increases in width in comparison with) the other portions of the first score line 430 is provided. More specifically, in the exemplary embodiment, the groove width changing portion 435 is provided in the part located on the one end part 431 side beyond the connection in the first score line 430.

Here, the first score line 430 will be described in detail. The first score line 430 is formed by the groove as mentioned above. In the groove, a bottom surface 430A, a first side surface 430B connected to the bottom surface 430A, and a second side surface 430C also connected to the bottom surface 430A are provided.

The first side surface 430B is located on one side of the bottom surface 430A in the width direction of the groove. Further, the first side surface 430B is formed toward the upper side (upper side in the vertical direction, front side direction of the paper sheet in the figure) from the connection with the bottom surface 430A. The second side surface 430C is located on the other side of the bottom surface 430A in the width direction of the groove. Further, the second side surface 430C is formed toward the upper side from the connection with the bottom surface 430A, similarly to the first side surface 430B.

The groove width changing portion 435 functioning as a speed decreasing unit is formed by applying a curvature to each of part of the first side surface 430B and part of the second side surface 430C and by outwardly expanding each of the part of the first side surface 430B and the part of the second side surface 430C. That is to say, in the exemplary embodiment, a concave portion is formed on each of the first side surface 430B and the second side surface 430C to form the groove width changing portion 435.

Figure 7:
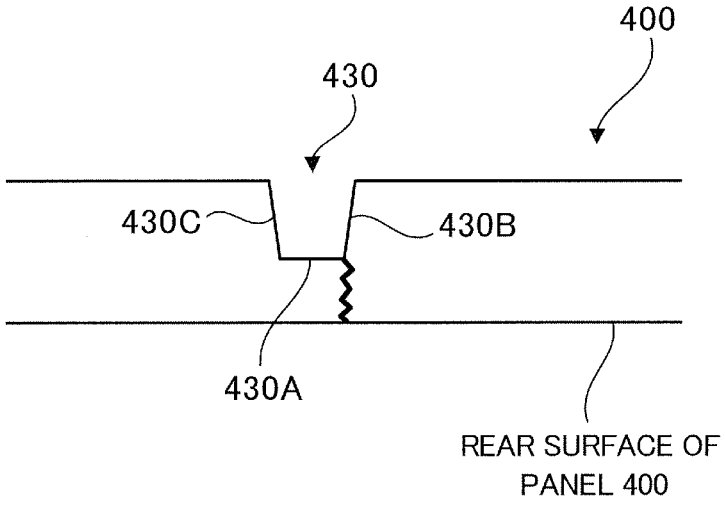
FIG. 7 is a cross-sectional view taken along a line VII-VII in FIG. 6.

FIG. 7 is a cross-sectional view taken along a line VII-VII in FIG. 6.

As described above and shown in FIG. 7, the first score line 430 includes the bottom surface 430A, the first side surface 430B extending upward from the connection with the bottom surface 430A, and the second side surface 430C extending upward from the connection with the bottom surface 430A.

Usually, cracking of the panel 400 along the first score line 430 may occurs at a part below the connection (corner) between the bottom surface 430A and the one side surface. More specifically, for example, the cracking of the panel 400 is likely to occur at the lower part below the connection between the first side surface 430B and the bottom surface 430A, as shown in FIG. 7. That is to say, cracking of the panel 400 is likely to occur at a part between the rear surface of the panel 400 and the connection between the first side surface 430B and the bottom surface 430A. Further, the cracking progresses along the first score line 430.

As a result, in the exemplary embodiment, in the case where the cracking of the panel 400 occurs from the connection toward the one end part 431 of the first score line 430, sequential cracking of the panel 400 occurs in the lower part below the first side surface 430B, and thereby cracking of the panel 400 progresses along a route shown in an arrow 6A in FIG. 6, for example.

If the groove width changing portion 435 is provided as described in the exemplary embodiment under the situation where such cracking may occur, the progress direction of the cracking greatly changes at a part denoted by a reference numeral 6B in FIG. 6, and thus the cracking is difficult to progress. In this case, the progress rate of the cracking is temporarily decreased (delayed). Further, in this case, shearing force acting on the part (part denoted by a reference numeral 6C) located on the upper side of the connection in the figure increases, and thereby cracking of the panel 400 is likely to occur on the other end part 432 side beyond the connection.

Note that, in the exemplary embodiment, the progress direction of cracking greatly changes also in a part denoted by a reference numeral 6D in addition to the part denoted by the reference numeral 6B, and the situation in which cracking is difficult to progress temporarily occurs. In other words, in the exemplary embodiment, plural changing points where the progress direction greatly changes are provided, and the situation in which cracking is difficult to progress occurs at the plural changing points. In this case, the panel 400 cracks on the other end part 432 side easier than in the case where only one changing point is provided.

Figure 8:
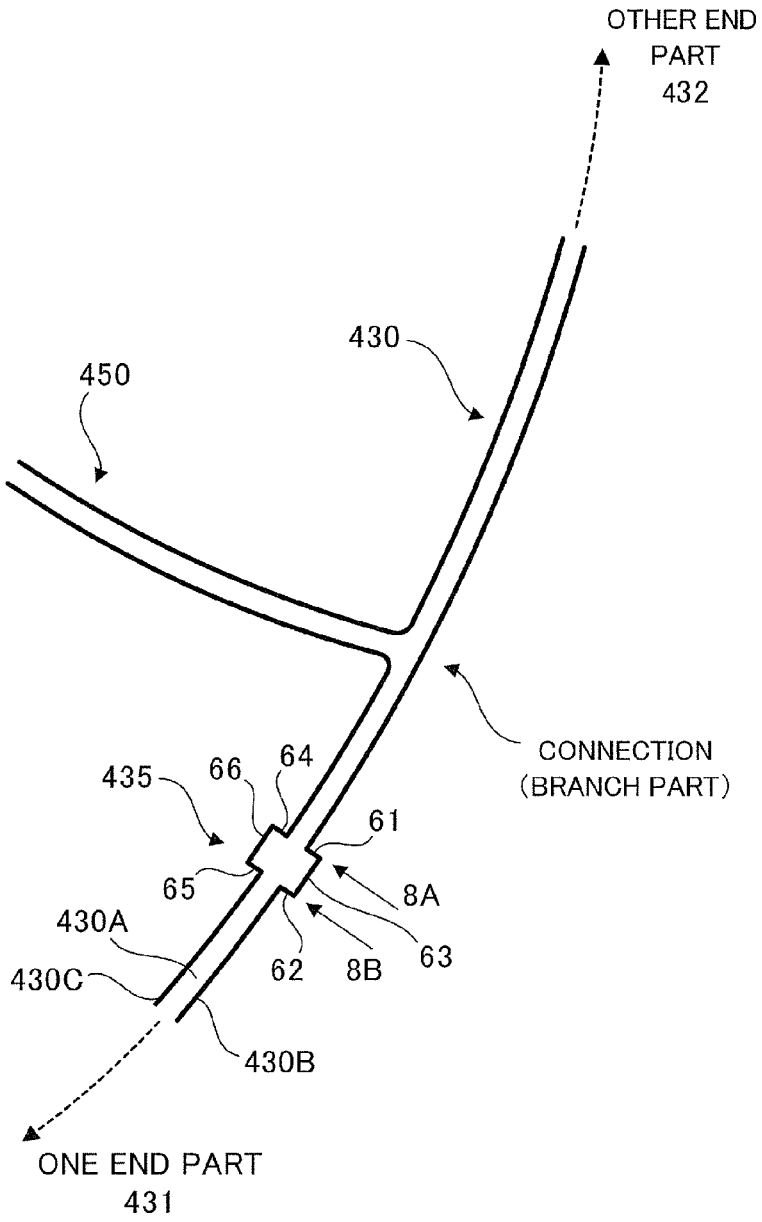
FIG. 8 is an enlarged view of the connection between the first score line and the second score line.

Note that, the shape of the groove width changing portion 435 is not limited to the shape shown in FIG. 6, and the groove width changing portion 435 may be formed into an outer shape of a rectangle, as shown in FIG. 8 (an enlarged view of the connection between the first score line 430 and the second score line 450). That is to say, although the outer shape of the groove width changing portion 435 shown in FIG. 6 is approximately a circle, the groove width changing portion 435 shown in FIG. 8 has the outer shape of a rectangle.

More specifically, in the groove width changing portion 435 shown in FIG. 8, a concave portion is formed on each of the first side surface 430B and the second side surface 430C, similarly to the groove width changing portion 435 shown in FIG. 6. Here, in the concave portion formed on the first side surface 430B, there are provided a first perpendicular surface 61 that is disposed to be perpendicular to the first side surface 430B, a second perpendicular surface 62 that is provided to the side further from the connection than the first perpendicular surface 61 and is disposed to be perpendicular to the first side surface 430B, and a connecting surface 63 connecting the first perpendicular surface 61 and the second perpendicular surface 62. Note that, the second side surface 430C side is similarly configured, and there are provided a first perpendicular surface 64, a second perpendicular surface 65, and a connecting surface 66.

For example, in the case where the panel 400 cracks sequentially along the first side surface 430B at the part below the first side surface 430B in the configuration example shown in FIG. 8, the progress rate of the cracking decreases firstly at a part denoted by a reference numeral 8A (the part where the first perpendicular surface 61 is provided) in the figure. Further, the progress rate of the cracking also decreases at a part denoted by a reference numeral 8B (the part where the second perpendicular surface 62 is provided) in the figure. In this case, similarly to the above, the shearing force acting on the other end part 432 side increases, and thereby the cracking of the panel 400 is likely to occur on the other end part 432 side beyond the connection.

Figure 9A:
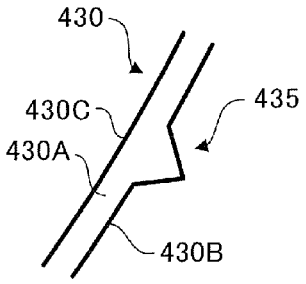
FIGS. 9A to 9H are views illustrating other shapes of the first score line.

Further, the groove width changing portion 435 can be formed into a shape shown in FIGS. 9A to 9H (views illustrating other shapes of the first score line 430). In the configuration example shown in FIG. 9A, the groove width changing portion 435 is formed by providing a concave portion only on the first side surface 430B. Note that, in the configuration example, the concave portion having the outer edge shape of a triangle is formed, as shown in FIG. 9A. However, the outer edge shape is not limited to the triangle, and may be a rectangle or a semicircle, as an example. Although the concave portion is formed on the first side surface 430B in the configuration example, the concave portion is alternatively formed on the second side surface 430C if there is high possibility of occurrence of cracking of the panel 400 at the part below the second side surface 430C.

Figure 9B:
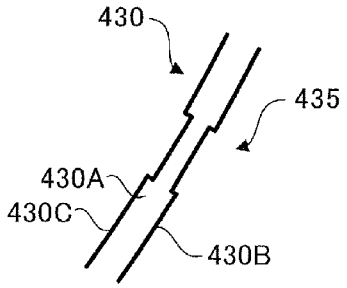
Figure 9C:
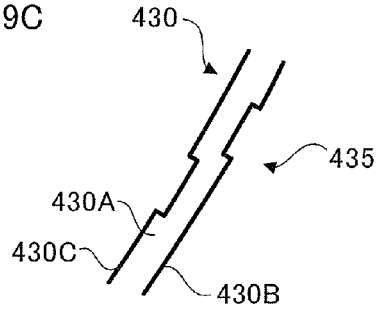

As shown in FIG. 9B, the groove width changing portion 435 may be formed by providing a convex portion on each of the first side surface 430B and the second side surface 430C to partially decrease the groove width. Note that, in the configuration example, the convex portion having the outer edge shape of a rectangle is formed. However, the outer edge shape may be another shape such as a semicircle, a triangle, or a trapezoid. Further, as shown in FIG. 6C, two convex portions are provided on the first side surface 430B and the second side surface 430C, respectively, and the two convex portions may be different in position from each other in the direction where the first score line 430 extends.

Here, the first score line 430 in the exemplary embodiment is formed by pressing a mold onto the panel 400. In the case of the configuration example shown in FIG. 9B, the thickness of the part fitting with the section between the one convex portion and the other convex portion in the mold becomes small, and thus the part having the small thickness is likely to be broken. In the configuration example shown in FIG. 9C, the thickness of the part where the groove width changing portion 435 is to be formed in the mold is increased, and thus the mold is not likely to be broken in comparison with the configuration example shown in FIG. 9B.

Figure 9D:
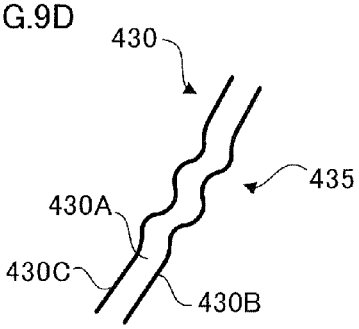
Figure 9E:
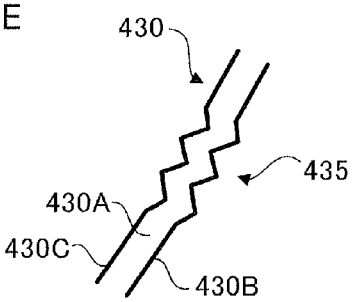

Note that, part of the first side surface 430B or the like is bent by forming a concave portion or a convex portion on the first side surface 430B or the like in the aforementioned configuration, and thereby the progress rate of the cracking is delayed, although the description thereof has been omitted. However, progress of the cracking can be delayed even by the configuration where no bending part is formed, as shown in FIG. 9D. In the configuration example shown in FIG. 9D, each of part of the first side surface 430B and part of the second side surface 430C is formed to have waves, and thereby the progress route of cracking, other than a linear route, is prepared. Accordingly, the progress of the cracking is delayed. Note that the waves may be formed by connecting plural planes as shown in FIG. 9E.

In the above, there has been described the configuration in which the groove width is changed only in the groove width changing portion 435, and the groove width is back to the original groove width on the downstream side beyond the groove width changing portion 435. However, the changed groove width may be kept on the downstream side beyond the groove width changing portion where the groove width is changed. Specifically, the shape such as FIG. 9F or 9G can be formed. In each of these configuration examples, the progress rate of the cracking decreases at the part denoted by a reference numeral 9A.

The description will be given further for the configuration examples shown in FIGS. 9F and 9G. In each of the configuration examples, a step is provided on each of the first side surface 430B and the second side surface 430C (at the part denoted by the reference numeral 9A), and the progress rate of the cracking decreases at the part where the step is provided.

Figure 9F:
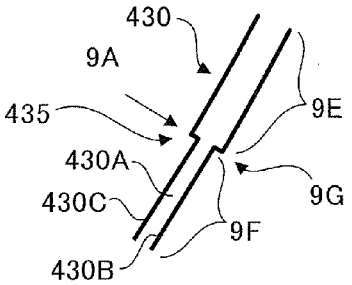
Figure 9G:
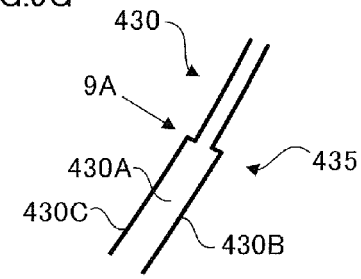

The description will be further given for the first side surface 430B in FIG. 9F as an example. A first section 9E is provided at the part of the first side surface 430B opposed to the second side surface 430C. Moreover, a second section 9F located to be closer to the second side surface 430C is provided at a part different from the part where the first section 9E is provided in the extending direction of the first score line 430. In the configuration example, a step 9G is provided between the first section 9E and the second section 9F. In the configuration example, in the case where cracking progresses along the first section 9E for example, the progress rate of the cracking is temporarily delayed at the part where the step 9G is provided.

Figure 9H:
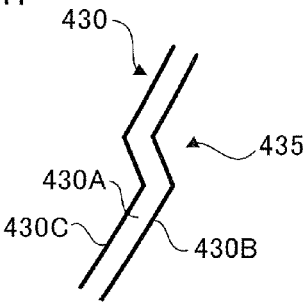

As shown in FIG. 9H, an extending direction of the first score line 430 can be changed in the middle, to decrease the progress rate of the cracking at the part where the extending direction changes. That is to say, in the configuration example shown in FIG. 9H, the first score line 430 is bent twice, to decrease the progress rate of the cracking of the panel 400 at each of the bending parts.

In the above, the groove width changing portion 435 is provided only on the one end part 431 side beyond the connection. However, the groove width changing portion 435 may be provided on each of the one end part 431 side and, the other end part 432 side beyond the connection. However, in this case, the number of the groove width changing portions 435 on the one end part 431 side should be increased in comparison with the number of the groove width changing portions 435 on the other end part 432 side, to achieve a state where cracking is more difficult to progress on the one end part 431 side than on the other end part 432 side.

With reference to FIG. 3 again, the can lid 300 will be further described.

In the exemplary embodiment, on a region between the one end part 431 and the other end part 432 of the first score line 430 (a part to become the base of the tongue part), a groove 600 is provided as shown in FIG. 3. This groove 600 is formed from the side where the one end part 431 is provided toward the side where the other end part 432 is provided. By this configuration, the tongue part is easily folded in the exemplary embodiment. Note that, the groove 600 is not essential, and may be omitted. The groove 600 is not limited to be straight, and may have a curve.

Figure 10:
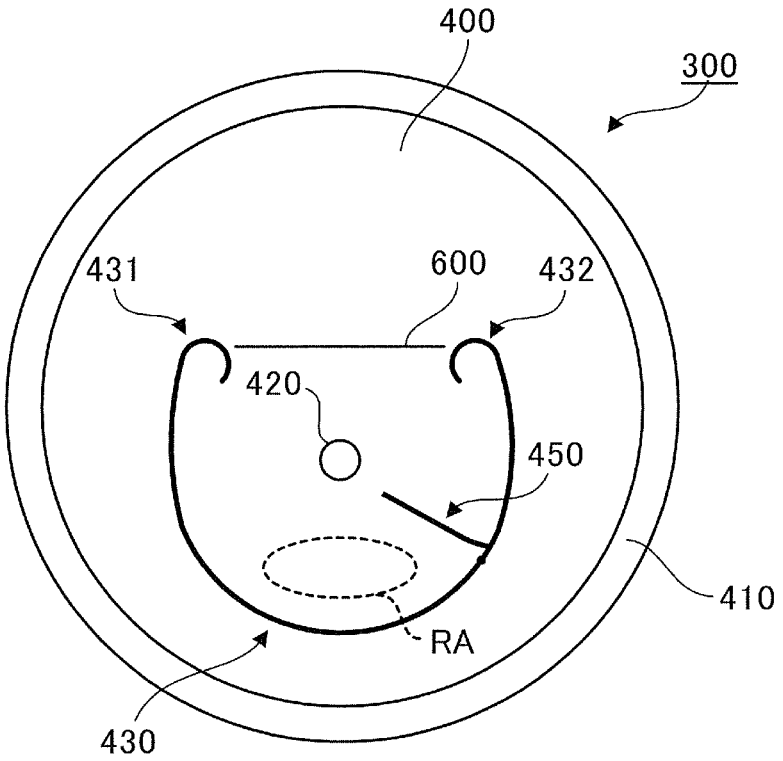
FIG. 10 is a view illustrating another configuration example of the can lid.

Although the description has been given for, as one example, the case where the second score line 450 is provided to pass between the region PA and the protrusion 420 as described above in the exemplary embodiment, the arrangement configuration of the second score line 450 is not limited to the above configuration. For example, as shown in FIG. 10 (a view illustrating another configuration example of the can lid 300), the second score line 450 that does not pass between the region RA and the protrusion 420 may be provided. In addition, the shape of the second score line 450 is not particularly limited, and the second score line 450 may curve.

In the exemplary embodiment, the one end part 431 and the other end part 432 of the first score line 430 inward curl toward the inside of the region surrounded by the first score line 430 as shown in the FIG. 3. Thus, the first score line 430 comes closer to the center line CL of the tab 500, toward the terminal end of the first score line 430.

Here, in the exemplary embodiment, cracking of the panel 400 occurs toward the one end part 431 and the other end part 432 of the first score line 430 as described above. However, if each of the one end part 431 and the other end part 432 of the first score line 430 curls, the progress direction in the first score line 430 greatly changes at the one end part 431 and the other end part 432. In this case, the cracking of the panel 400 stops at the one end part 431 and the other end part 432.

Figure 11:
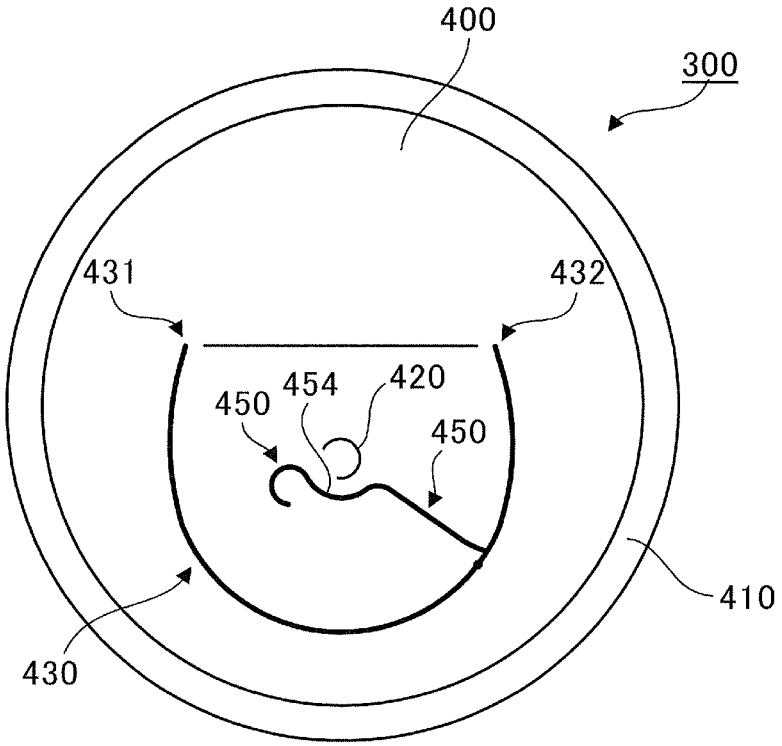
FIG. 11 is a view illustrating still another configuration example of the can lid.

For example, as shown in FIG. 11 (a view illustrating still another configuration example of the can lid 300), if the one end part 431 and the other end part 432 have no curl and are formed to be straight, the cracking of the panel 400 is likely to occur at the part beyond each of the one end part 431 and the other end part 432 (the part on the extension line of the first score line 430, the part where cracking is not planned).

REFERENCE SIGNS LIST

100 . . . Beverage can
200 . . . Container body (can body)
300 . . . Can lid
400 . . . Panel
430 . . . First score line
430A . . . Bottom surface
430B . . . First side surface
430C . . . Second side surface
435 . . . Groove width changing portion
450 . . . Second score line

The invention claimed is:

1. A can lid comprising:

a panel that is attachable to an opening portion of a can body;

at least one branched score line that is formed on the panel, that extends toward a predetermined extending direction, then is branched at a branch part, and further extends toward a plurality of directions, that comprises a first branched score line and a second branched score line on a downstream side beyond the branch part in the extending direction, and that promotes cracking of the panel; and a speed decreasing unit that is provided so as to correspond to the at least one branched score line of the first branched score line and the second branched score line, and that temporarily decreases a progress rate in progressing cracking of the panel along the at least one branched score line of the first branched score line and the second branched score line.

2. The can lid according to claim 1, wherein the one branched score line is formed by a groove on a surface of the panel, the one branched score line has any one of a part where the groove decreases in width and a part where the groove increases in width, and the progress rate is temporarily decreased at any one of the part where the groove decreases in width and the part where the groove increases in width.

3. The can lid according to claim 1, wherein the one branched score line is formed by a groove on a surface of the panel, the groove comprises a bottom part, a first side surface, and a second side surface, the first side surface being located on one side of the groove in a width direction of the groove and facing an inside of the groove, the second side surface being located on an opposing side of the groove in the width direction of the groove and facing inside of the groove, any one of a convex portion and a concave portion is formed on at least one side surface of the first side surface and the second side surface, and the progress rate is temporarily decreased at a part where any one of the convex portion and the concave portion is provided.

4. The can lid according to claim 1, wherein the one branched score line is formed by a groove on a surface of the panel, the groove comprises a bottom part, a first side surface, and a second side surface, the first side surface being located on one side of the groove in a width direction of the groove and facing an inside of the groove, the second side surface being located on an opposing side of the groove in the width direction of the groove and facing the inside of the groove, a first section and a second section are provided on at least one side surface of the first side surface and the second side surface, and a step is formed between the first section and the second section, the first section being located to be opposed to a corresponding section of a other side surface, the second section being disposed at a different position from the first section in the extending direction of the groove and being located to be close to another of the at least one side surface of the first side surface and the second side surface in comparison with the first section, and the progress rate is temporarily decreased at a part where the step is provided.

5. The can lid according to claim 1, wherein the one branched score line is formed to change the extending direction in thea middle of extending toward the downstream side of the extending direction, and the progress rate is temporarily decreased at a part where the extending direction of the one branched score line is changed.

6. A beverage can comprising:

a can body that contains a drink, and a can lid that is attached to the can body, wherein the can lid is the can lid according to claim 1.

7. A can lid comprising:

a panel that is attachable to an opening portion of a can body;

at least one branched score line that is formed on the panel, that extends toward a predetermined extending direction, then is branched at a branch part, and further extends toward a plurality of directions, that comprises a first branched score line and a second branched score line on a downstream side beyond the branch part in the extending direction, and that promotes cracking of the panel, and a unit that is provided to correspond to one or both of the first branched score line and the second branched score line, and that temporarily delays cracking of the panel progressing along the at least one branched score line of the first branched score line and the second branched score line.

8. A beverage can comprising:

a can body that contains a drink, and a can lid that is attached to the can body, wherein the can lid is the can lid according to claim 7.

* * * * *